United States Patent [19]

Rebikoff

[11] 4,355,855

[45] Oct. 26, 1982

[54] DEEP WATER CONNECTOR

[76] Inventor: Dimitri Rebikoff, 3060 SW. 4th Ave., Fort Lauderdale, Fla. 33315

[21] Appl. No.: 186,752

[22] Filed: Sep. 12, 1980

Related U.S. Application Data

[63] Continuation of Ser. No. 9,797, Feb. 7, 1979, abandoned.

[51] Int. Cl.[3] ..... H01R 13/52

[52] U.S. Cl. ..... 339/94 A; 339/101

[58] Field of Search ..... 339/60 R, 60 M, 94, 339/103 R, 103 M, 101

[56] References Cited

U.S. PATENT DOCUMENTS 3,259,872 7/1966 Kyle ..... 339/94 A 3,487,160 12/1969 Johnsen ..... 339/101

*Primary Examiner*—Joseph H. McGlynn

*Attorney, Agent, or Firm*—Malin & Haley

[57] ABSTRACT

A waterproof, electrical connector with a bulkhead mounted receptacle having an "O"-ring or other expandable gasket compressed between the bulkhead and the mating surface of the receptacle shell. Another "O"-ring in the inside circumference of the one piece receptacle shell is compressed when the one piece plug shell is mated with the receptacle, thus forming a unitary type shell. A reinforced hose is secured by double turn clamps, one forward clamp on the nipple or rear of the plug shell at a point away from the end of the plug shell and beyond a shoulder at the rear of the plug shell and another rearward clamp on the cable connected to the plug. Any leakage of fluid is prevented from reaching the contacts or flowing through the connector by the placement of these "O"-rings and the clamped hose.

2 Claims, 4 Drawing Figures

10
12
14
16
18
20
22
24
26
28
30
32
34
38
40
44
46
48
52
54
54a
56
58
58'
62
64
66
68
70
72
74
78

12
16
22
32
34
54a
62
64
66
68
70
72
78

26
28
32
34
44
46
48
52
54
56

14
16
58'
76

DEEP WATER CONNECTOR

This is a continuation of application Ser. No. 9,797, filed Feb. 7, 1979, now abandoned.

BACKGROUND OF THE INVENTION

Various types of waterproof connectors using gland seals have been used in the past. These type connectors have been subject to cable pull-out and tend to lose their seal as the fluid pressure on the plug and cable increases. The present invention prevents cable pull-out and tends to tighten the seal proportionally as the fluid pressure increases or cable pull increases.

SUMMARY OF THE INVENTION

The present invention relates to a new and improved waterproof, electrical connector, and more particularly to a bulkhead mounted receptacle including a plurality of "O"-rings and a plurality of pin contacts, a unitary plug shell including a coupling ring for connection to the receptacle, a plurality of socket contacts and a raised shoulder near the rear perimeter of the plug shell, and a diagonally biased multiply reinforced hose secured by a plurality of clamps to the plug shell and a cable connected thereto. When the connector is made-up, the reinforced hose is connected to the rear exterior of the plug shell by double turn clamps which circumscribe the reinforced hose at positions such that a raised shoulder near the rear of the plug shell, the end of the plug shell and a portion of the connected cable external to the plug are held within the spacial distance between the clamps. The relation of the reinforced hose and clamps with respect to the plug shell and cable prevents the intrusion of water along the cable and into the rear of the plug, and also prevents the cable from being pulled out. The diagonally opposed hose tightens up as the cable pulls along the spirally wound diagonally opposed plies. Thus, the hose holds the cable in the plug.

The receptacle is mounted in a bulkhead such that an "O"-ring, which is held in a groove on the rear vertical surface is compressed between the bulkhead and the receptacle when the receptacle is mounted in the bulkhead.

Another "O"-ring is mounted in a circumferential groove on the inside of the receptacle shell's base nut such that the "O"-ring, when the connector is mated, is compressed between the outer circumference of the plug and the inner circumference of the shell.

When the connector is properly mated with the "O"-rings, reinforced hose, and clamps in their proper place, the connection will stay waterproof. The force on the reinforced hose increases proportionally to an increase in fluid pressure, thus the connector maintains the watertight integrity at increased pressure.

It is an object of this invention to provide a connector that can separate two different fluids, or a fluid and a vacuum, or an explosive atmosphere from an ignition hazard.

It is another object of this invention to have the main "O"-ring housed inside the base nut of the receptacle shell for minimum size and weight.

It is a further object of this invention to prevent pull-out of the cable from the plug as pull on the cable increases.

It is still a further object of this invention to provide a seal which tends to tighten onto the cable as the fluid pressure increases.

In accordance with these and other objects which will be apparent hereinafter, the instant invention will now be described with particular reference to the accompanying drawings.

BRIEF DESCRIPTION OF THE DRAWINGS

The present invention is herein described and illustrated with respect to particular preferred embodiments thereof, as illustrated in the accompanying drawings, wherein.

DESCRIPTION OF THE PREFERRED EMBODIMENT

Figure 3:
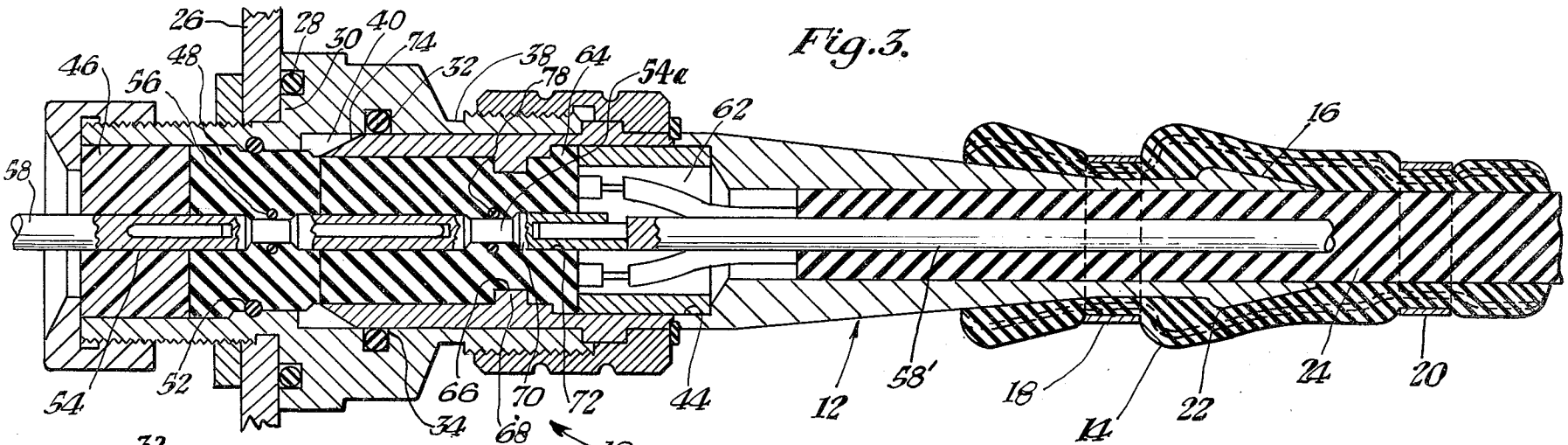
FIG. 3 is a cross-sectional view along the longitudinal center line of the mated connector mounted on a bulkhead with the reinforced hose secured to the plug shell.
Figure 1:
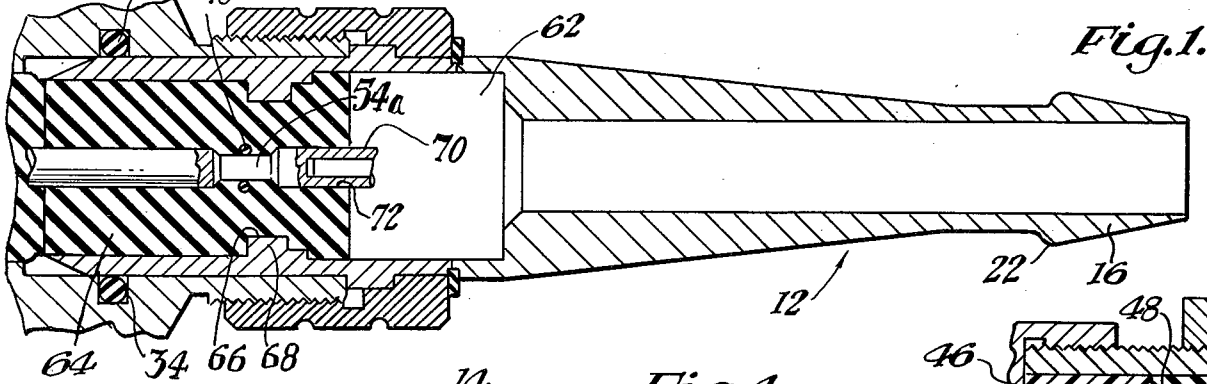
FIG. 1 is a cross-sectional view of the male plug taken along the longitudinal center line.
Figure 2:
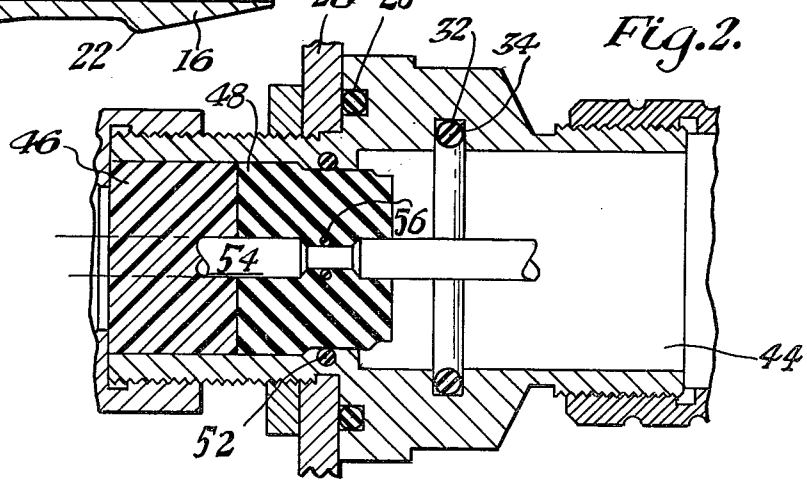
FIG. 2 is a cross-sectional view of the female receptacle taken along the longitudinal center line.

Considering now the present invention in some detail and referring to the drawings, it is noted that in FIGS. 1, 2 and 3 there is illustrated an embodiment of the present invention consisting of a bulkhead mounted female receptacle 10 which connects to a male plug 12 with a multiply reinforced hose wrap 14 secured to the nipple 16 or end by two clamps 18 and 20, each with a double turn.

When the receptacle 10 and the plug 12 are made up, as in FIG. 3, the reinforced hose 14 is connected to the rear exterior or nipple 16 of said plug 12 by double turn clamps 18 and 20 which circumscribe the hose at points such that a shoulder 22 around said nipple 16 and a portion of the connected cable 24 are held in spaced relation between said clamps 18 and 20.

The receptacle 10 is a generally cylindrical one-piece shell having a longitudinal cavity 44 therethrough. The cavity 44 receives a rear pin insert 46, for example, of hard plastic, and a front pin insert 48, for example, of silicone rubber. The front pin insert 48 has an O-ring 52 circumscribed about the outer surface such that the O-ring 52 is compressed between the outer surface of the front pin insert 48 and the inside surface of the longitudinal cavity 44 when the front pin insert 48 is placed within the longitudinal cavity 44.

The rear pin insert 46 and the front pin insert 48 are both placed within the longitudinal cavity 44, and have a longitudinal aperture therethrough for securing a pin contact 54 therein. The pin contact 54 also has an O-ring 56 circumscribed about it for mating with the front pin insert 48. A wire conductor 58 is connected to the pin contact 54 using the normal procedure of one skilled in the art.

The plug 12 is a generally cylindrical one-piece shell having a longitudinal cavity 62 therethrough. The longitudinal cavity 62 receives a front socket insert 64, for example, of silicone rubber. The front socket insert 64 has a recess 66 circumscribed about the outer surface which mates with a raised protuberance 68 on the inside surface of the longitudinal cavity 62 of the plug 12, when the front socket insert 64 is placed within the cavity 62.

The front socket insert 64 has an aperture 72 therethrough for insertion of a socket contact 70 therein. The socket contact has an O-ring circumscribed about the outer surface for mating with the aperture 72 of the front socket insert 64. The socket contact 70 receives the narrower portion 54*a* of the pin contact 54 when the receptacle 10 is mated with the plug 12. The receptacle 10 and plug 12 may have a plurality of contacts therein. A wire conductor 58' is connected to the socket contact 70 using a standard procedure of one skilled in the art.

The receptacle 10 is mounted in a bulkhead 26 such that an O-ring 28 or other expandable gasket is compressed between the bulkhead 26 and the vertical surface 30 of said receptacle 10 when said receptacle 10 is mounted in the bulkhead 26.

An O-ring 32 is mounted in a circumferential groove 34 on the inside of the receptacle shell 10 such that said O-ring 32 is compressed between the outer surface 38 of the plug 12 and the inner surface 40 of said receptacle 10 when the connectors are mated. The front edge 74 of the plug 12 is beveled to provide ease of egress of the plug 12 into the receptacle 10 past the O-ring 32. The relationship of said O-rings 28 and 32 and said clamped hose 14 to said receptacle 10 and said plug 12 in forming a single solid shell from the cable 24 to the mating surface 30 prevents any fluid from leaking into or along the interior of said made-up connector. The large surface area ratio between the double turn clamps 18 and 20 and the cross sectional area of the cable 24 prevents the cable 24 from moving along the interior of the plug 12 by a piston-like action, that is, the higher the fluid pressure on the hose 14, the tighter the sealing action.

Figure 4:
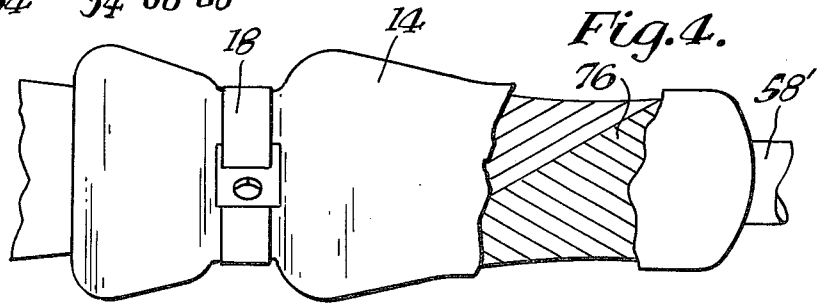
FIG. 4 is an elevational view of the reinforced hose, partially broken away to illustrate the diagonally opposed plies.

FIG. 4 illustrates the layers of biased plies of the reinforced hose 14. The diagonal opposed reinforcing, non-stretch fabric plies 76 (such as dacron, Kevlar, or steel) cause proportional tightening when the cable is pulled out, combining with the water pressure to lock the cable securely either way.

The preferred design for the least possible diameter, volume, weight and cost of receptacle 10 is to recess the internal "O"-ring 32 inside the wider pedestal or base nut 36 of the bulkhead half or female shell part 52 of the connector system. This location has the additional advantage to fully protect the internal "O"-ring seal 32 from dirt, sunlight, cuts or any other environmental-related damage.

Any other type of similar principle floating seal, such as square "V" or "X" section, can be used.

The male part or plug 12 of the connector mounted on a flexible cable with an elastic polymer smooth jacket is a solid one-pieced component without any joint or opening from the "O"-ring 32 mating polished cylindrical surface to the end of the nipple 16 carrying the sealing sleeve.

The hose wrap 14 or sealing sleeve may be any adequate flexible polymer outside, but the inside must be vulcanized natural hard or "surgical" rubber or equivalent synthetic fully elastic polymer without permanent cold flow. The preferred reinforcement is an even number, such as 2 or 4, of diagonal non-stretchable textile or metal thread 78, either woven or laid in opposite spirals between 15 and 60 degrees of spiral angle.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A watertight electrical connector for joining a first electrical cable and a second electrical cable separated by a boundary which segregates the environments in which the first and second electrical cables are placed, comprising:

a receptable means for mounting in said boundary, said receptable means including:

a generally cylindrical first body with a longitudinal through bore for defining an enclosed internal chamber, said first body having a first receptacle portion for connection of said first electrical cable on one side of said boundary and a second receptacle portion adjacent the other side of said boundary, a first insert means having a first longitudinal hollow aperture therethrough carried by said first body in said longitudinal through bore, a second insert means having a second longitudinal hollow aperture therethrough carried by said first body in said longitudinal through bore at the end of said first receptacle portion of said first body, pin contact means for connecting said first electrical cable disposed in said longitudinal hollow aperture in said first and second insert means, a first gasket means for compression between said boundary and said second receptacle portion such that a waterproof seal exists therebetween, a second gasket means circumscribed about the longitudinal through bore of said first body for sealing said longitudinal through bore, a plug means for engagement in said longitudinal through bore of said receptable means, said plug means including:

a generally cylindrical second body with a longitudinal through bore for defining an enclosed internal chamber, said second body having a first plug portion connectable in said longitudinal through bore of said receptacle means and a second plug portion which extends longitudinally beyond said receptacle means when said first plug portion is inserted therein;

reinforcing means for watertight connection of said second electrical cable to said second plug portion, such that any force which would tend to cause longitudinal movement of said second electrical cable relative to said second plug portion causes tightening of said reinforcing means proportional to said force, preventing movement of said second electrical cable.

2. An electrical connector as set forth in claim 1, wherein:

said reinforcing means includes diagonal opposed reinforcing, nonstretch fabric plies.

* * * * *